US010030869B2

(12) United States Patent
Gibson et al.

(10) Patent No.: US 10,030,869 B2
(45) **Date of Patent: *Jul. 24, 2018**

(54) PREMIX FUEL NOZZLE ASSEMBLY

(71) Applicant: General Electric Company, Schenectady, NY (US)

(72) Inventors: Michael Christopher Gibson, Spartanburg, SC (US); Dereck Joseph Ouellet, Mason, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 546 days.

This patent is subject to a terminal disclaimer.

(21) Appl. No.: 14/555,074

(22) Filed: Nov. 26, 2014

(65) Prior Publication Data

US 2016/0146459 A1 May 26, 2016

(51) Int. Cl.
*F23D 17/00* (2006.01)
*F23R 3/14* (2006.01)
(Continued)

(52) U.S. Cl.
CPC ..... *F23D 17/002* (2013.01); *F23R 3/14* (2013.01); *F23R 3/286* (2013.01); *F23R 3/343* (2013.01);
(Continued)

(58) Field of Classification Search
CPC ..... F23D 17/00; F23D 17/002; F23D 2900/14021; F23R 3/14; F23R 3/286;
(Continued)

(56) References Cited

U.S. PATENT DOCUMENTS 4,100,733 A 7/1978 Striebel et al.
4,589,260 A 5/1986 Krockow
(Continued)

FOREIGN PATENT DOCUMENTS

EP 2405201 A2 1/2012
EP 2693123 A1 2/2014
WO WO 2014/081334 5/2014

OTHER PUBLICATIONS

Copending U.S. Appl. No. 14/688,170, filed Apr. 16, 2015.
(Continued)

*Primary Examiner* — Thai Ba Trieu
*Assistant Examiner* — Loren Edwards
(74) *Attorney, Agent, or Firm* — Dority & Manning, PA

(57) ABSTRACT

A premix fuel nozzle assembly includes a center body including a sleeve having an inner surface and a pilot premix fuel nozzle assembly that extends axially through the center body within the sleeve and defines a pilot air passage within the center body. The pilot premix fuel nozzle assembly includes a premix tip having a plurality of premix tubes that define premix passages in fluid communication with the pilot air passage. At least one of the premix tubes includes a fuel port. The premix fuel nozzle assembly further includes a pilot fuel flow path that is defined radially between the pilot premix fuel nozzle assembly and the inner surface of the sleeve and a fuel plenum that is at least partially defined between the sleeve inner surface and an outer surface of the premix tip. The fuel ports provide for fluid communication between the fuel plenum and the premix passages.

19 Claims, 12 Drawing Sheets

(51) Int. Cl.
*F23R 3/28* (2006.01)
*F23R 3/34* (2006.01)
*F23R 3/36* (2006.01)

(52) U.S. Cl.
CPC ..... *F23R 3/36* (2013.01); *F23D 2900/14021* (2013.01)

(58) Field of Classification Search
CPC .... F23R 3/32; F23R 3/343; F23R 3/36; F23R 2900/03343
USPC ..... 60/737
See application file for complete search history.

(56) References Cited

U.S. PATENT DOCUMENTS 4,850,194 A 7/1989 Fuglistaller et al.
4,890,453 A 1/1990 Iwai et al.
4,982,570 A 1/1991 Waslo et al.
5,199,265 A 4/1993 Borkowicz
5,235,814 A * 8/1993 Leonard ..... F23R 3/283 60/738
5,263,325 A 11/1993 McVey et al.
5,675,971 A 10/1997 Angel et al.
5,755,090 A 5/1998 Hu
5,901,555 A * 5/1999 Mandai ..... F23D 23/00 60/39.826
6,298,667 B1 10/2001 Glynn et al.
6,363,724 B1 4/2002 Bechtel et al.
6,438,961 B2 8/2002 Tuthill et al.
6,446,439 B1 9/2002 Kraft et al.
6,609,380 B2 8/2003 Mick et al.
6,857,271 B2 2/2005 Kraft et al.
7,007,477 B2 3/2006 Widener
7,854,121 B2 12/2010 Vandale et al.
8,240,150 B2 8/2012 Varatharajan et al.
8,347,631 B2 1/2013 Bailey et al.
8,919,673 B2 12/2014 Subramanian et al.
9,297,535 B2 3/2016 Uhm et al.
2005/0229600 A1 10/2005 Kastrup et al.
2009/0165436 A1 7/2009 Herbon et al.
2009/0223228 A1 9/2009 Romoser
2010/0031661 A1 2/2010 Varatharajan et al.
2010/0084490 A1 4/2010 Zuo et al.
2010/0293954 A1 11/2010 Widener
2010/0293955 A1 11/2010 Berry et al.
2010/0319353 A1 12/2010 Intile
2011/0005229 A1 1/2011 Venkataraman et al.
2011/0162371 A1 7/2011 Khan et al.
2011/0252803 A1 10/2011 Subramanian et al.
2012/0073302 A1 3/2012 Myers et al.
2012/0096866 A1 4/2012 Khan et al.
2012/0167586 A1 7/2012 Bailey et al.
2012/0192565 A1 8/2012 Tretyakov et al.
2013/0219899 A1* 8/2013 Uhm ..... F23R 3/14 60/738
2013/0219903 A1 8/2013 Koizumi et al.
2013/0306181 A1 11/2013 Mitchell et al.
2013/0312422 A1 11/2013 Westmoreland et al.
2014/0041389 A1 2/2014 Kajimura et al.
2014/0190168 A1* 7/2014 Shershnyov ..... F23R 3/283 60/737

OTHER PUBLICATIONS

Copending U.S. Appl. No. 14/555,143, Jason Thurman Stewart, filed Nov. 26 , 2014.
Berry et al., U.S. Appl. No. 14/102,846, filed Dec. 11, 2013.
Stewart et al., U.S. Appl. No. 14/555,143, filed Nov. 26, 2014.
Romig et al., U.S. Appl. No. 14/688,170, filed Apr. 16, 2015.
Stewart, U.S. Appl. No. 14/691,864, filed Apr. 21, 2015.
Berry et al., U.S. Appl. No. 15/221,747, filed Jul. 28, 2016.
Non-Final Rejection towards related U.S. Appl. No. 14/555,143 dated Nov. 1, 2016.
U.S. Non-Final Office Action issued in connection with related U.S. Appl. No. 14/102,846 dated Mar. 24, 2016.
U.S. Notice of Allowance issued in connection with related U.S. Appl. No. 14/102,846 dated Jul. 6, 2016.
European Search Report and Opinion issued in connection with related EP Application No. 16165555.0 dated Sep. 13, 2016.
GB Search Report and Opinion issued in connection with related GB Application No. 1606106.1 dated Oct. 13, 2016.

* cited by examiner

PREMIX FUEL NOZZLE ASSEMBLY

FIELD OF THE INVENTION

The present invention generally involves a premix fuel nozzle assembly for a gas turbine combustor. More specifically, the invention relates to a dual fuel premix fuel nozzle assembly that is configured for gas only operation.

BACKGROUND OF THE INVENTION

Gas turbine combustors for power generation are generally available with fuel nozzles configured for either "Dual Fuel" operation or for "Gas only" operation. "Gas Only" refers to a fuel nozzle that is restricted to providing a gaseous fuel such as natural gas for combustion in a combustion chamber of the combustor. "Dual Fuel" refers to a fuel nozzle that may be configured to provide either a liquid fuel or a gaseous fuel for combustion during operation of the combustor. Typically, the combustor will operate on gaseous fuel, however, the liquid fuel may be used as a backup or alternative fuel in the event the gaseous fuel becomes unavailable or supply is limited. In certain configurations, a gas turbine combustor may be designed to include multiple "Dual Fuel" fuel nozzles arranged annularly about a center fuel nozzle and/or a common axial centerline.

In a conventional "Dual Fuel" fuel nozzle, the liquid fuel is supplied through a liquid fuel nozzle or cartridge that extends axially within a center body portion of the fuel nozzle. The gaseous fuel is typically injected into a swirling flow of compressed air flowing through an annular passage defined between the center body and an outer burner tube, thus premixing the gaseous fuel with the compressed air before it is directed into a combustion zone defined downstream from the fuel nozzle. In particular configurations, a pilot premix nozzle or tip is disposed at a tip portion of the center body and is concentrically aligned with the liquid fuel nozzle. During operation the pilot premix nozzle may be used to provide a generally stabilized pilot flame during diffusion operation of the gas turbine even at a low fuel-to-air ratio, thus enhancing emissions performance of the combustor.

Although a gas turbine may include combustors that have "Dual Fuel" or backup fuel capability, it may not be required by the operator or in some cases the liquid fuel may not be available and/or may not be cost effective. On a gas turbine that is not required to have backup fuel capability, a gas only cartridge is provided in place of the liquid fuel nozzle, thus converting the otherwise "Dual Fuel: fuel nozzle to a "Gas Only" fuel nozzle. Purge air is directed through the gas only cartridge to keep the cartridge tip temperatures to within acceptable levels during operation of the combustor.

In particular combustors having premixed pilot nozzles, the purge air flows from the gas only cartridge and into a pilot flame provided by the premixed pilot nozzle. As a result, the purge air may decrease the stability of the pilot which may impact the performance of the combustor. Therefore an improved dual fuel premix fuel nozzle assembly, particularly one having a pilot premix nozzle and/or a gas only cartridge configured to reduce effects of purge air one the pilot flame provided by the pilot premix nozzle would be useful.

BRIEF DESCRIPTION OF THE INVENTION

Aspects and advantages of the invention are set forth below in the following description, or may be obvious from the description, or may be learned through practice of the invention.

One embodiment of the present invention is a premix fuel nozzle assembly. The premix fuel nozzle assembly includes a center body that is at least partially defined by a sleeve having an inner surface. The premix fuel nozzle assembly further includes a pilot premix fuel nozzle assembly that extends axially through the center body within the sleeve and that defines a pilot air passage within the center body. The pilot premix fuel nozzle assembly includes a premix tip having a plurality of premix tubes where each premix tube defines a premix passage and a fuel port. The premix passage is in fluid communication with the pilot air passage. A pilot fuel flow path defined radially between the pilot premix fuel nozzle assembly and the inner surface of the sleeve of the center body. A fuel plenum is at least partially defined between the sleeve inner surface and an outer surface of the premix tip. The fuel ports provide for fluid communication between the fuel plenum and the premix passages.

Another embodiment of the present disclosure is a combustor. The combustor includes an end cover and a plurality of premix fuel nozzle assemblies annularly arranged about a center fuel nozzle and fixedly connected to the end cover. Each of the premix fuel nozzle assemblies being a dual fuel type premix fuel nozzle assembly, wherein each premix fuel nozzle assembly includes a center body that is at least partially defined by a sleeve having an inner surface. A pilot premix fuel nozzle assembly extends axially through the center body within the sleeve and defines a pilot air passage within the center body. The pilot premix fuel nozzle assembly includes a premix tip having a plurality of premix tubes where each premix tube has an inlet end, and outlet end and a premix passage defined therebetween. Each premix tube includes at least one fuel port. The inlet end of the premix tube is in fluid communication with the pilot air passage. The premix fuel nozzle assembly further includes a pilot fuel flow path defined radially between the pilot premix fuel nozzle assembly and the inner surface of the sleeve of the center body, and a fuel plenum at least partially defined between the sleeve inner surface and an outer surface of the premix tip. The fuel ports provide for fluid communication between the fuel plenum and the premix passages.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
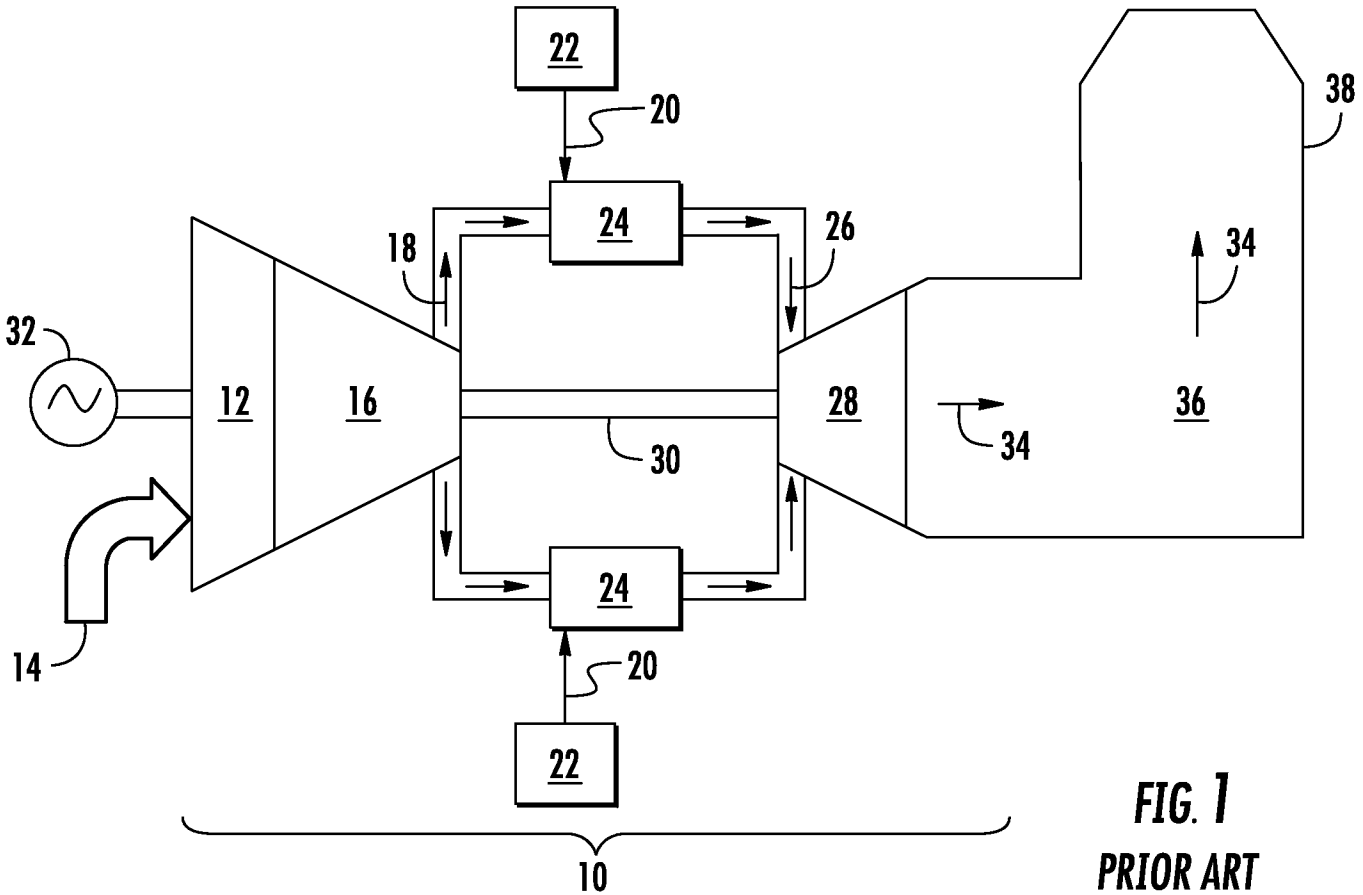
FIG. 1 PRIOR ART
FIG. 1 is a functional block diagram of an exemplary gas turbine that may incorporate various embodiments of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents. Although exemplary embodiments of the present invention will be described generally in the context of a premix fuel nozzle assembly for a land based power generating gas turbine combustor for purposes of illustration, one of ordinary skill in the art will readily appreciate that embodiments of the present invention may be applied to any style or type of combustor for a turbomachine and are not limited to combustors or combustion systems for land based power generating gas turbines unless specifically recited in the claims.

Referring now to the drawings, wherein identical numerals indicate the same elements throughout the figures, FIG. 1 provides a functional block diagram of an exemplary gas turbine 10 that may incorporate various embodiments of the present invention. As shown, the gas turbine 10 generally includes an inlet section 12 that may include a series of filters, cooling coils, moisture separators, and/or other devices to purify and otherwise condition air 14 or other working fluid entering the gas turbine 10. The air 14 flows to a compressor section where a compressor 16 progressively imparts kinetic energy to the air 14 to produce compressed air 18.

The compressed air 18 is mixed with a fuel 20 from a fuel supply system 22 to form a combustible mixture within one or more combustors 24. The combustible mixture is burned to produce combustion gases 26 having a high temperature, pressure and velocity. The combustion gases 26 flow through a turbine 28 of a turbine section to produce work. For example, the turbine 28 may be connected to a shaft 30 so that rotation of the turbine 28 drives the compressor 16 to produce the compressed air 18. Alternately or in addition, the shaft 30 may connect the turbine 28 to a generator 32 for producing electricity. Exhaust gases 34 from the turbine 28 flow through an exhaust section 36 that connects the turbine 28 to an exhaust stack 38 downstream from the turbine 28. The exhaust section 36 may include, for example, a heat recovery steam generator (not shown) for cleaning and extracting additional heat from the exhaust gases 34 prior to release to the environment.

Figure 2:
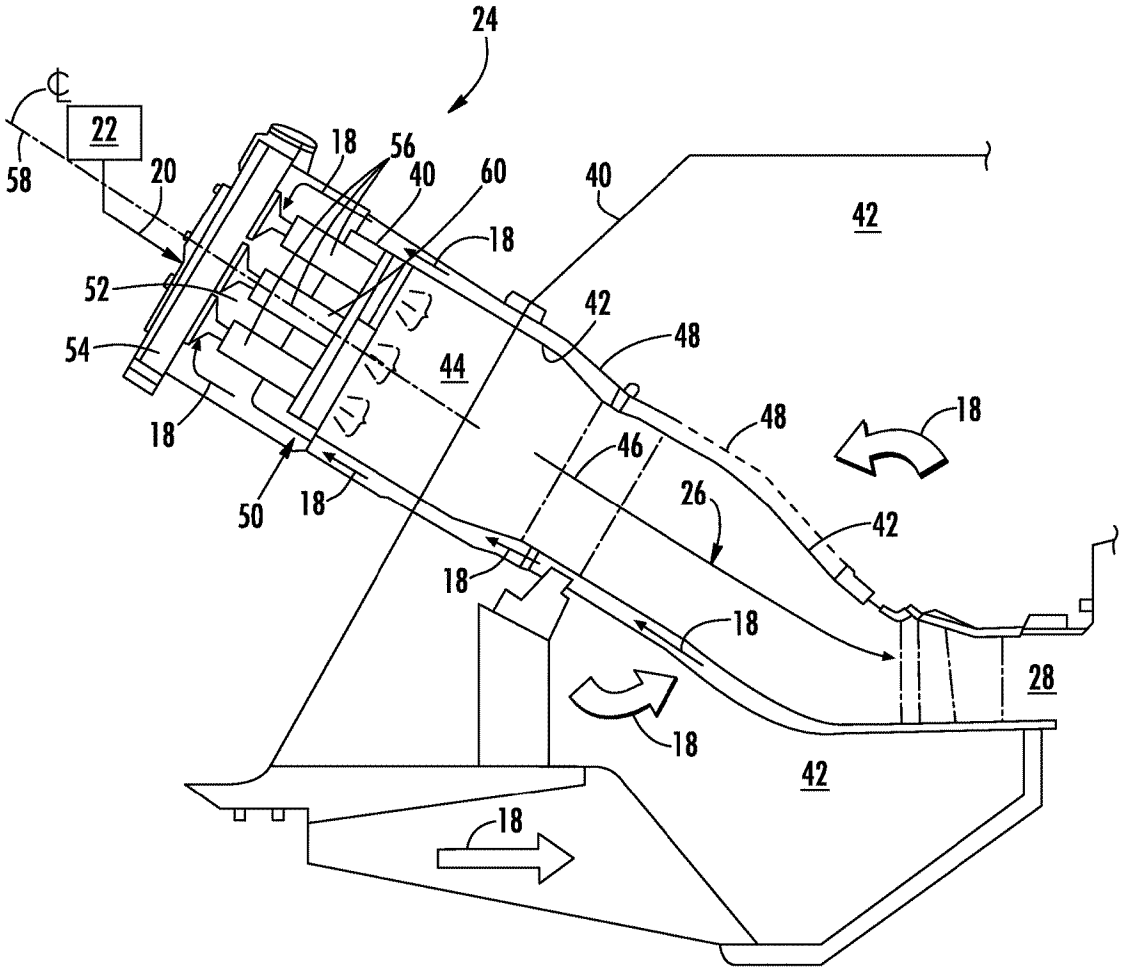
FIG. 2 is a side perspective view of an exemplary combustor as may incorporate various embodiments of the present invention.

The combustor 24 may be any type of combustor known in the art, and the present invention is not limited to any particular combustor design unless specifically recited in the claims. For example, the combustor 24 may be a can-annular or an annular combustor. FIG. 2 provides a perspective side view of a portion of an exemplary combustor 24 as may be incorporated in the gas turbine 10 shown in FIG. 1 and as may incorporate one or more embodiments of the present invention.

In an exemplary embodiment, as shown in FIG. 2, the combustor 24 is at least partially surrounded by an outer casing 40. The outer casing 40 is in fluid communication with a compressed air source such as the compressor 16 (FIG. 1). The combustor 24 may include one or more liners 42 such as a combustion liner and/or a transition duct that at least partially define a combustion chamber 44 within the outer casing 40. The liner(s) 42 may also at least partially define a hot gas path 46 for directing the combustion gases 26 into the turbine 28. In particular configurations, one or more outer sleeves 48 such as a flow sleeve or impingement sleeve may at least partially surround the liner(s) 44. The outer sleeve(s) 48 is radially spaced from the liner(s) 42 so as to define an annular flow path 50 for directing a portion of the compressed air 18 towards a head end portion 52 of the combustor 24. The head end portion 52 may be at least partially defined by an end cover 54 that is fixedly connected to the outer casing 40. In various embodiments, the combustor 24 includes a plurality of fuel nozzle assemblies 56 disposed within or encased within the outer casing 40.

Figure 3:
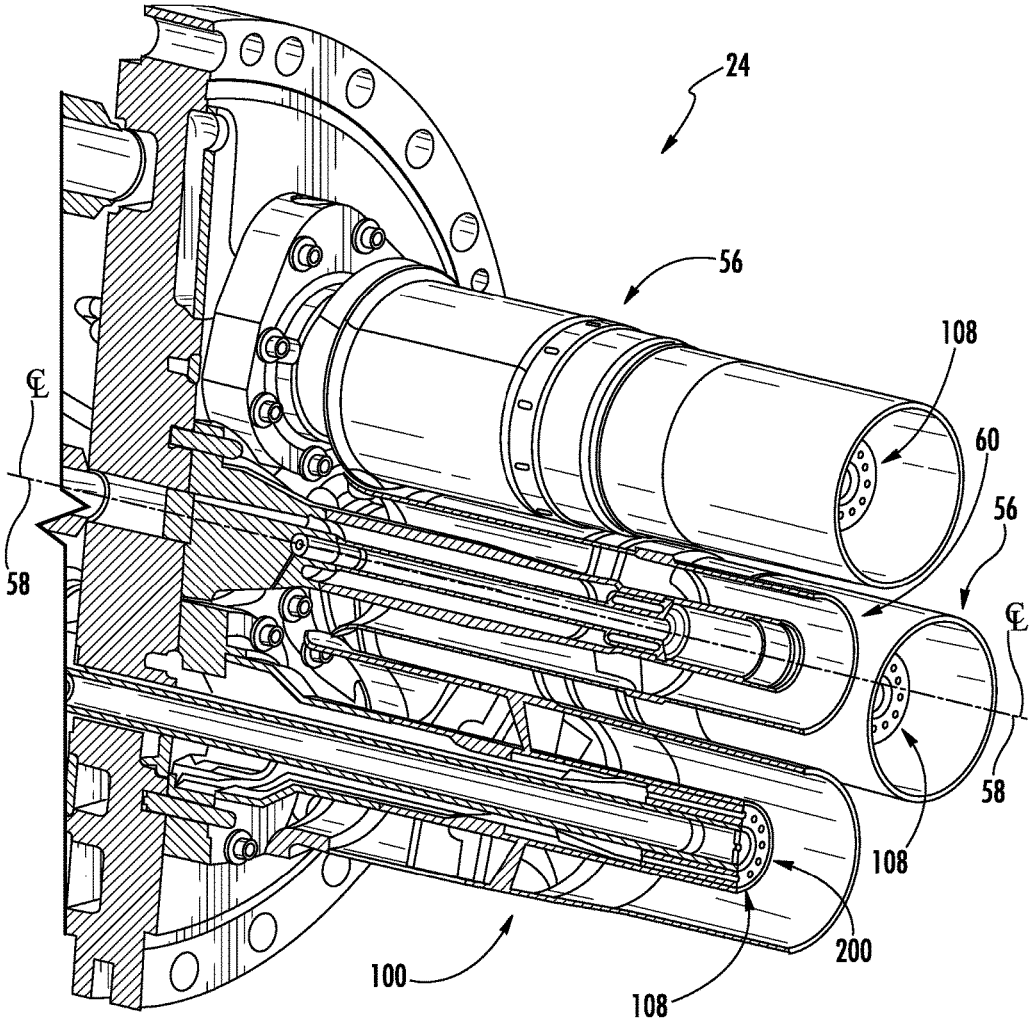
FIG. 3 is a perspective side view of a portion of an exemplary combustor as may incorporate one or more embodiments of the present invention.

FIG. 3 provides a perspective side view of a portion of an exemplary combustor 24 as may incorporate one or more embodiments of the present invention. As shown in FIG. 3, the fuel nozzle assemblies 56 may be annularly arranged around a common axial centerline 58 and/or a center fuel nozzle assembly 60 which is substantially coaxially aligned with centerline 58. In various embodiments, each fuel nozzle assembly 56 is connected at one end to the end cover 54. The fuel nozzle assemblies 56, 60 may be in fluid communication with the fuel source 22 (FIG. 2) via the end cover 54 and/or a fluid coupling (not shown).

Figure 4:
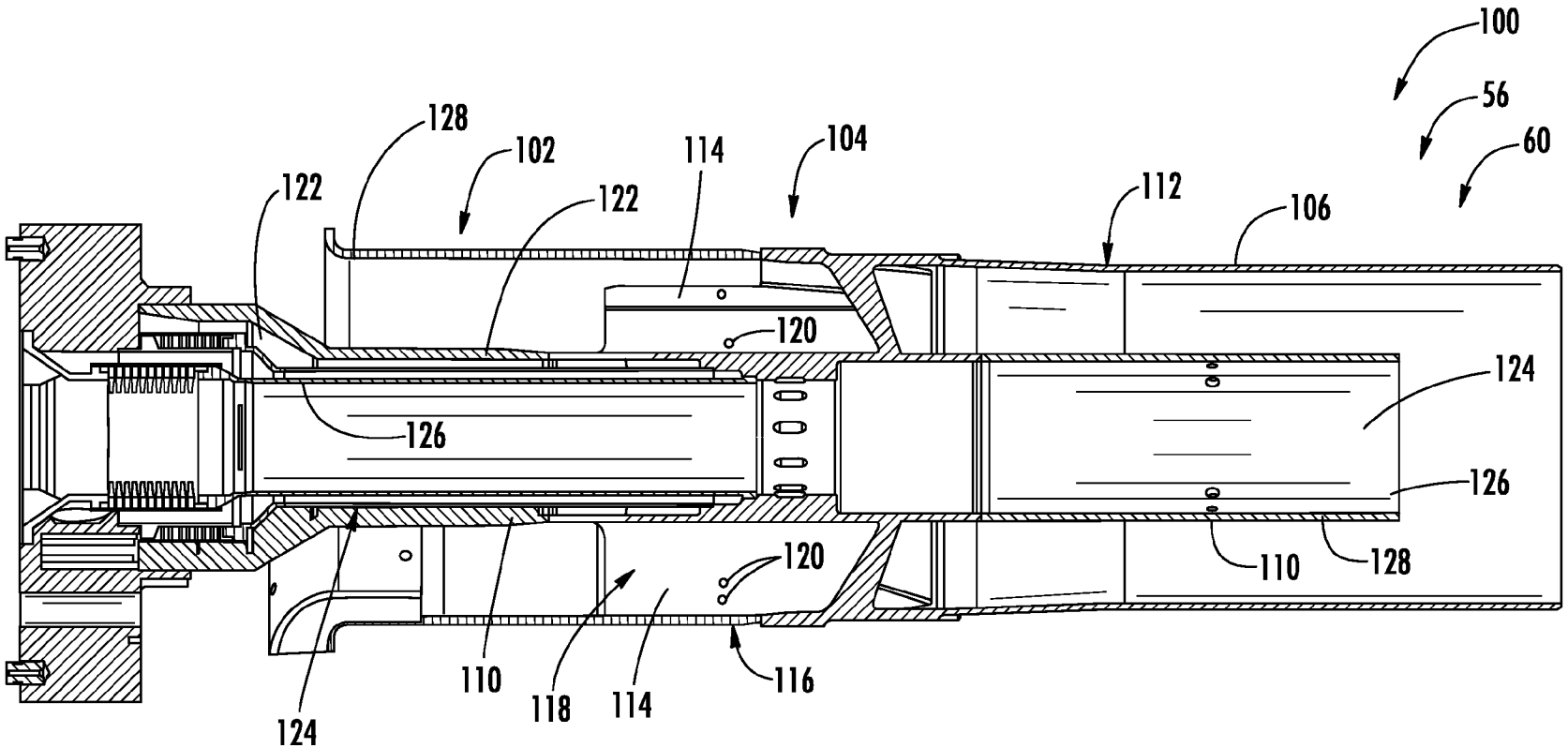
FIG. 4 is a cross sectioned side view of an exemplary premix fuel nozzle assembly as may be incorporated in the combustor as shown in FIG. 3, according to one or more embodiments of the present invention.

FIG. 4 provides a cross sectioned side view of an exemplary premix fuel nozzle assembly 100 as may be incorporated in the combustor 24 as shown in FIG. 3, according to one or more embodiments of the present invention. Premix fuel nozzle assembly 100 may be representative of one, any or all of the fuel nozzle assemblies 56, 60 shown in FIGS. 2 and 3 and is not limited to any particular location or position along the end cover 54 or within the combustor 24 unless otherwise recited in the claims. The premix fuel nozzle assembly 100 is a "dual fuel" type premix fuel nozzle, as a result, the premix fuel nozzle assembly 100 as provided herein is one of a type of premix fuel nozzles that may be configured or modified to burn or operate on either a gaseous fuel or a liquid fuel.

As shown in FIG. 4, the premix fuel nozzle assembly 100 is generally divided into various regions by function. In particular configurations as shown in FIG. 4, the premix fuel nozzle assembly 100 includes an inlet flow conditioner 102, an air swirler assembly 104 with gas fuel injection and an annular fuel/air mixing passage 106. In various embodiments, as shown in FIG. 3, premix fuel nozzle assembly 100 includes a diffusion or pilot premix nozzle assembly 108. The pilot premix nozzle assembly 108 (FIG. 3) is mounted or seated within a center body 110 (FIG. 4) of the premix fuel nozzle assembly 100. Although shown in FIG. 4 as part of the premix fuel nozzle assembly 100, the inlet conditioner 102 is not a necessary component of the premix fuel nozzle assembly 100 unless recited otherwise in the claims.

In particular embodiments, as shown in FIG. 4, the annular fuel/air mixing passage 106 is generally defined between an outer sleeve or burner tube 112 and the center body 110. The swirler assembly 104 includes swirler vanes 114 which extend between the center body 110 and an outer sleeve 116 such as the burner tube 112. The center body 110 and the outer sleeve 116 define an annular passage 118 therebetween upstream from the annular fuel/air mixing passage 106. In particular configurations, one or more fuel injection ports 120 are formed along each swirler vane 114. The fuel injection ports 120 provide for fluid communication between one or more fuel circuits 122 formed within the center body 110, and the annular passage 118. The center body 110 is at least partially defined by one or more annular shaped sleeves 124. Each sleeve 124 includes an inner side or surface 126 that is radially separated from an outer side or surface 128.

In operation, a portion of the compressed air 18 enters the swirler assembly 104 of the premix fuel nozzle assembly 100 via the inlet flow conditioner 102 (when present). The swirler vanes 114 impart angular swirl to the compressed air 18 as it flows through the annular passage 118. A gaseous fuel such as natural gas is injected into the compressed air 18 via the injection ports 120. The gaseous fuel begins mixing with the compressed air 18 in the swirler assembly 104, and fuel/air mixing is completed in the annular passage 106. After exiting the annular passage 106, the fuel/air mixture 62 enters the combustion chamber 44 or reaction zone where combustion takes place.

Figure 5:
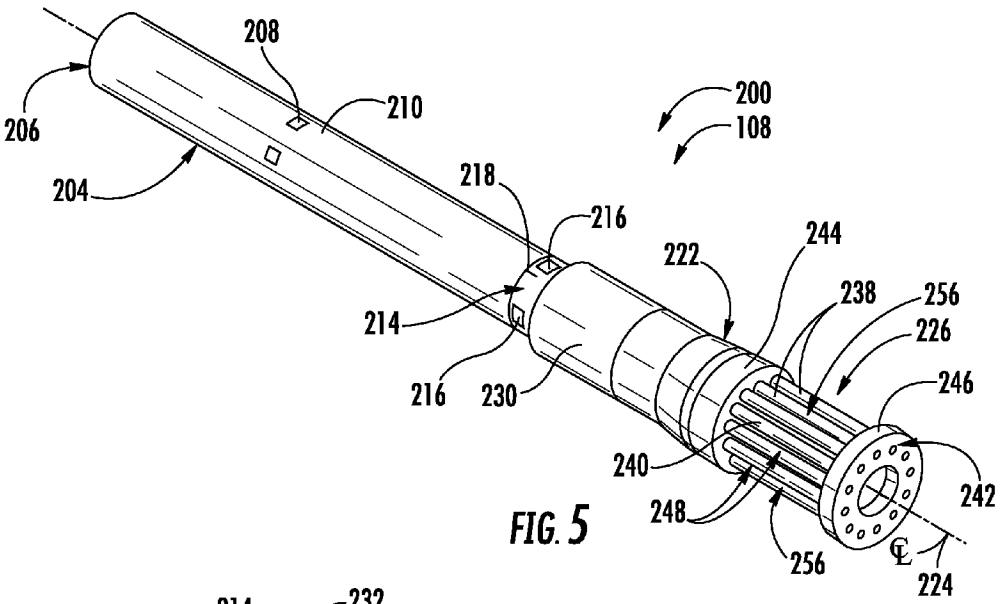
FIG. 5 is a perspective side view of an exemplary pilot premix fuel nozzle assembly as shown in FIG. 4 and as may be incorporated in the combustor as shown in FIG. 3, according to at least one embodiment.
Figure 6:
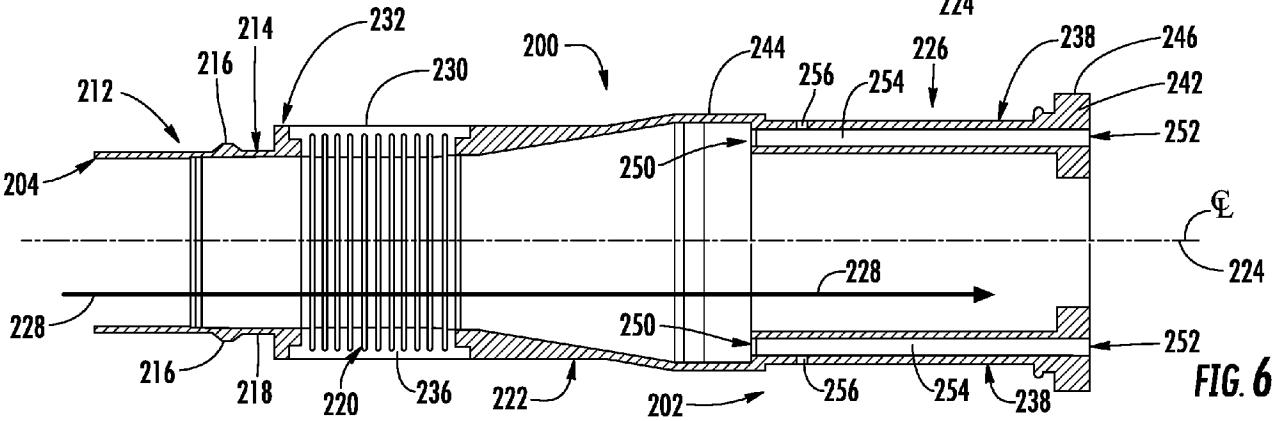
FIG. 6 is an enlarged cross sectioned side view of a downstream portion of the exemplary pilot premix fuel nozzle assembly as shown in FIG. 5, according to one or more embodiments of the present invention.

FIG. 5 provides a perspective side view of an exemplary pilot premix fuel nozzle assembly 200 as shown in FIG. 4 and as may be incorporated in the combustor 24 as shown in FIG. 3, according to one or more embodiments of the present invention. FIG. 6 provides an enlarged cross sectioned side view of a downstream portion 202 of the exemplary pilot premix fuel nozzle assembly 200 as shown in FIG. 5, according to one or more embodiments of the present invention. The exemplary pilot premix fuel nozzle assembly 200 may be representative of one, any or all of the pilot premix fuel nozzle assemblies 108 shown in FIG. 3 and is not limited to any particular premix fuel nozzle assembly 100 unless otherwise recited in the claims.

In various embodiments, as shown in FIG. 5, the pilot premix fuel nozzle assembly 200 includes an annular stem 204. A first or upstream end portion 206 of the stem 204 is configured or formed to interface with and/or be seated within an orifice of the end cover 54 (FIG. 3). The stem 204 may be in fluid communication with a pilot premix air supply (not shown). In one embodiment, as shown in FIG. 5, one or more alignment or standoff features 208 are formed or disposed along an outer surface 210 of the stem 204. The alignment features 208 may be clocked or circumferentially spaced around the outer surface 210 of the stem 204.

As shown in FIG. 6, the downstream portion 202 is coupled or connected to a downstream end portion 212 of the stem 204. In one embodiment, as shown in FIG. 6, the downstream portion 202 is coupled or connected to the downstream end portion 212 of the stem 204 via a coupling collar 214. In one embodiment, one or more alignment or standoff features 216 are formed or disposed along an outer surface 218 of the coupling collar 214. The alignment features 216 may be clocked or circumferentially spaced around the outer surface 218 of the coupling collar 214.

In various embodiments, the pilot premix fuel nozzle assembly 200 includes an annular shaped bellows 220 that is coupled at one end to the downstream end portion 212 of the stem 204 and/or to the coupling collar 214 and at an axially opposing end to a flow expansion collar 222. In particular embodiments, the stem 204, coupling collar 214, bellows 220 and flow expansion collar 222 may be concentrically aligned with respect to an axial centerline 224 of the pilot premix fuel nozzle assembly 200.

In various embodiments, as shown in FIGS. 5 and 6, the pilot premix fuel nozzle assembly 200 includes a premix tip 226 that extends axially downstream from the flow expansion collar 222 with respect to centerline 224. In particular embodiments, premix tip 226 is concentrically aligned with one or more of the stem 204, coupling collar 214, bellows 220 and flow expansion collar 222 with respect to centerline 224. The flow expansion collar 222 extends axially between the bellows 220 and the premix tip 226. Each of the stem 204, the coupling collar 214, the bellows 220, the flow expansion collar 222 and the premix tip 226 at least partially define a pilot air passage 228 through the pilot premix fuel nozzle assembly 200.

In particular embodiments, the pilot premix fuel nozzle assembly 200 includes an annular sleeve or liner 230 that circumferentially surrounds the bellows 220. In one embodiment, the liner 230 is engaged at a first end 232 with the stem 204 or the coupling collar 214 and engaged at a second end 234 with the flow expansion collar 222, thus forming a plenum or void 236 between the bellows 220 and the liner 230. The liner 230 may be fixedly engaged or may be slidingly engaged at the first or second ends 232, 234 with the stem 204, the coupling collar 214 or the flow expansion collar 222.

In one embodiment, the liner 230 is fixedly engaged at the first end 232 with the stem 204 or the coupling collar 214 and slidingly engaged at the second end 234 with the expansion collar 222, thus allowing for thermal expansion between the stem 204 and/or the coupling collar 214 and the premix tip 226. In one embodiment, the liner 230 is slidingly engaged at the first end 232 with the stem 204 or the coupling collar 214 and fixedly engaged at the second end 234 with the expansion collar 222, thus allowing for thermal expansion between the stem 204 and/or the coupling collar 214 and the premix tip 226. In one embodiment, the liner 230 is fixedly engaged at the first end 232 with the stem 204 or the coupling collar 214 and fixedly engaged at the second end 234 with the expansion collar 222, thus at least partially sealing the plenum or void 236 between the bellows 220 and the liner 230.

In various embodiments, as shown in FIGS. 5 and 6, the premix tip 226 includes a plurality of premix tubes 238 annularly arranged about or around an outer surface 240 (FIG. 5) of the premix tip 226. Each tube extends radially outwardly from the outer surface 240 (FIG. 5) of the premix tip 226. In particular embodiments, as shown in FIGS. 5 and 6, the premix tubes 238 extend axially with respect to centerline 224 between the flow expansion collar 222 and a fuel distribution disk or wall 242 of the premix tip 226. In particular embodiments, the outer surface 240 and/or the premix tubes 238 of the premix tip 226 are radially inset from a radially outer surface 244 of the flow expansion collar 222 and/or a radially outer surface 246 of the fuel distribution disk 242. In particular embodiments, as shown in FIG. 5, a valley or groove 248 is formed or defined between each circumferentially adjacent premix tube 238.

As shown in FIG. 6, each premix tube 238 includes an inlet end 250 and an outlet end 252. In particular embodiments, each premix tube 238 defines a premix flow passage 254 through the premix tip 226. The inlet end 250 is in fluid communication with the pilot air passage 228. The outlet end 252 of each premix tube 238 provides for fluid communication between the corresponding premix flow passage 254 and the combustion chamber or reaction zone 44 (FIG. 2). In particular embodiments, each or at least some of the premix tubes 238 includes one or more fuel ports 256 which provide for fluid communication into the corresponding premix passage 254.

Figure 7:
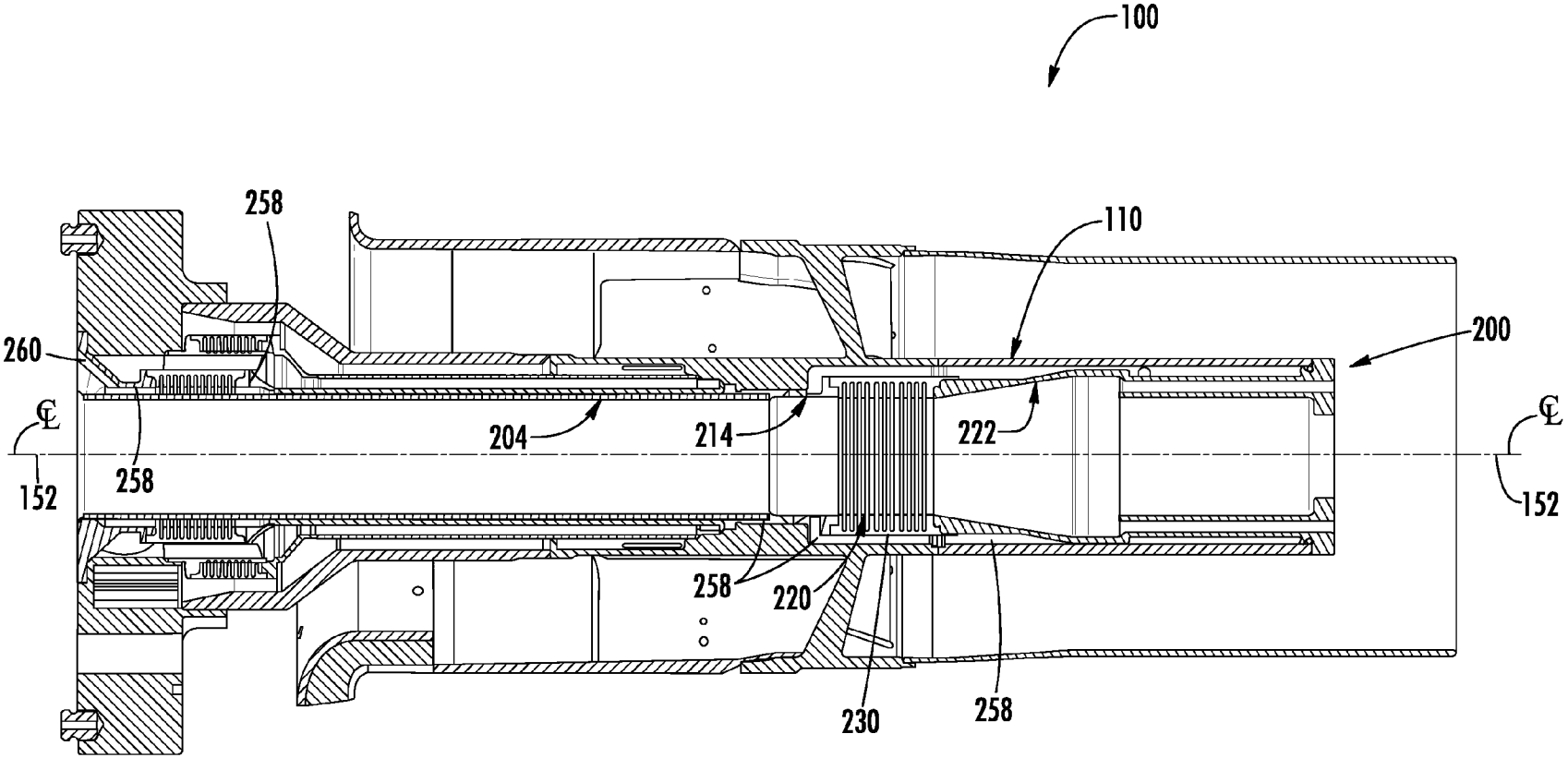
FIG. 7 is a cross sectioned side view of the exemplary premix fuel nozzle assembly as shown in FIGS. 5 and 6, according to one or more embodiments of the present invention.

FIG. 7 provides a cross sectioned side view of the exemplary premix fuel nozzle assembly 100 with the pilot premix fuel nozzle assembly 200 as shown in FIGS. 5 and 6 seated or mounted within the center body 110, according to one or more embodiments of the present invention. As shown in FIG. 7, the pilot premix fuel nozzle assembly 200 extends axially within the center body 110 with respect to centerline 152 of the premix fuel nozzle assembly 100. In particular embodiments, the pilot premix fuel nozzle assembly 200 is concentrically aligned with the center body 110 with respect to centerline 152. In particular embodiments, the pilot premix fuel nozzle assembly 200 may be fixedly connected at one end to the center body 110 at or proximate to the fuel distribution disk 242 and may be uncoupled or not fixed at the upstream end portion 206 of the stem 204, thus allowing for thermal expansion, particularly axial thermal expansion of the pilot premix fuel nozzle assembly 200 inside of the center body 110 via the bellows 220 during operation of the combustor 24.

In various embodiments, as shown in FIG. 7, a pilot fuel flow path 258 is at least partially defined between the inner surface(s) 126 of the sleeve(s) 124 of the center body 110 (FIG. 4) and at least a portion the pilot premix fuel nozzle assembly 200. In one embodiment, as shown in FIG. 7, the pilot fuel flow path 258 is defined between the inner side or surface(s) 126 of the sleeve(s) 124 of the center body 110 and the stem 204, the coupling collar 214 the bellows 220 and/or the bellows liner 230 and the flow expansion collar 222. In various embodiments, the pilot fuel flow path 258 is defined radially inwardly from the one or more fuel circuits 122 formed within the center body 110 which feed or supply fuel to the fuel injection ports 120 defined within the swirler vanes 114. The pilot fuel flow path 258 is generally fed by an inlet passage 260 which provides for fluid communication between the end cover 54 and/or a fuel source and the pilot fuel flow path 258.

Figure 8:
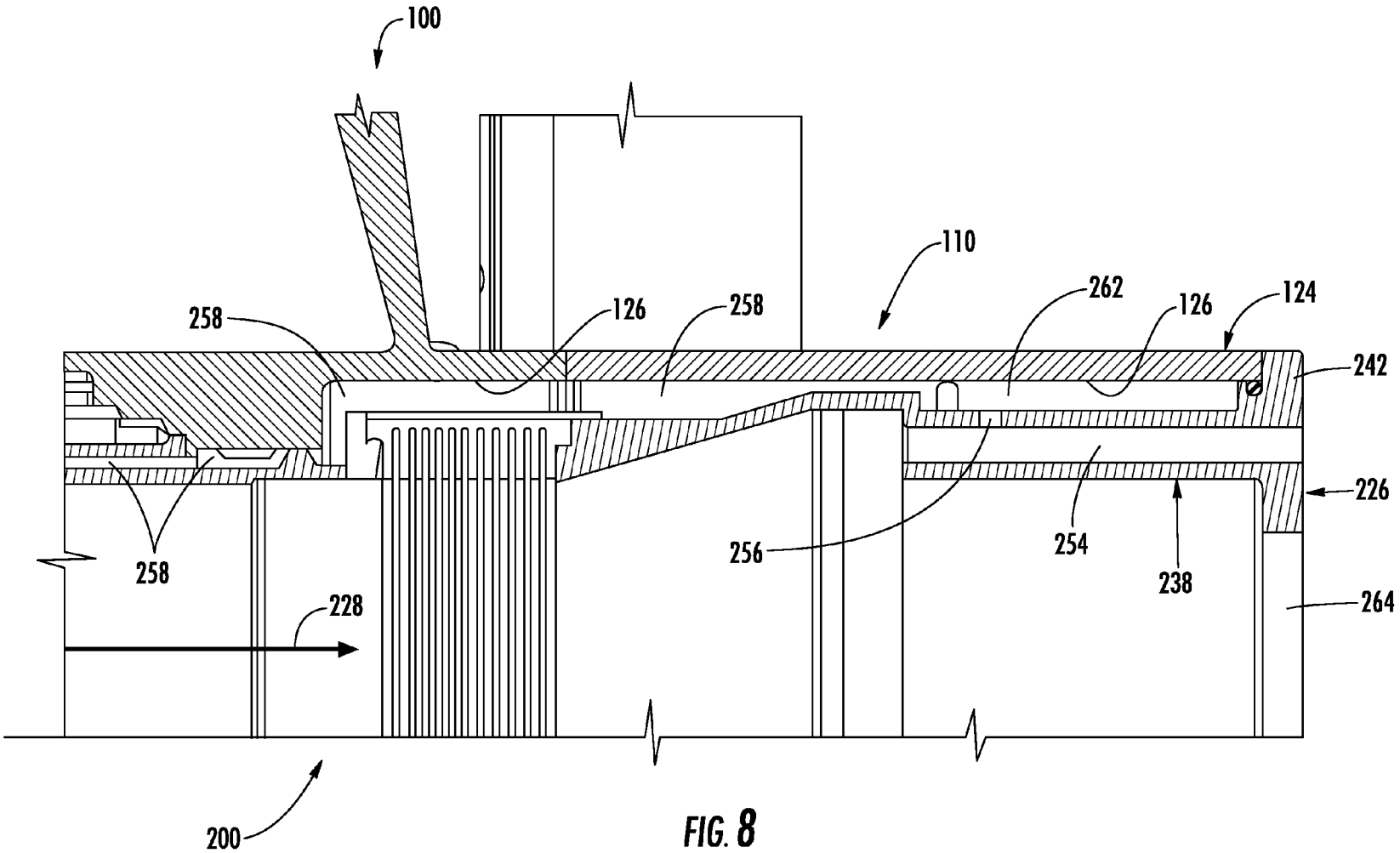
FIG. 8 is an enlarged cross sectioned side view of a portion of the premix fuel nozzle assembly as shown in FIG. 7, including a portion of a pilot premix fuel nozzle assembly according to one or more embodiments of the present invention

FIG. 8 is an enlarged cross sectioned side view of a portion of the premix fuel nozzle assembly 100 as shown in FIG. 7, including a portion of the pilot premix fuel nozzle assembly 200. In particular embodiments, as shown in FIGS. 7 and 8, a fuel plenum is at least partially defined and/or formed between the inner surface 126 of the sleeve(s) 124 of the center body 110 and the premix tip 226. In particular embodiments, the fuel plenum 262 is at least partially defined or formed between outer surfaces of the premix tubes 238 and/or the outer surface 240 (FIG. 5) of the premix tip 226 and the inner surface 126 of the sleeve(s) 124. The fuel plenum 262 is in fluid communication with the pilot fuel flow path 258. In various embodiments, the fuel ports 256 define a flow path between the fuel plenum 262 and the premix passages 254 of each corresponding premix tube 238. In particular embodiments, the pilot fuel flow path 258 provides a continuous fuel flow path between the end cover 54 (FIG. 3) and the fuel plenum 262 during piloted premix operation of the combustor 24.

Figure 9:
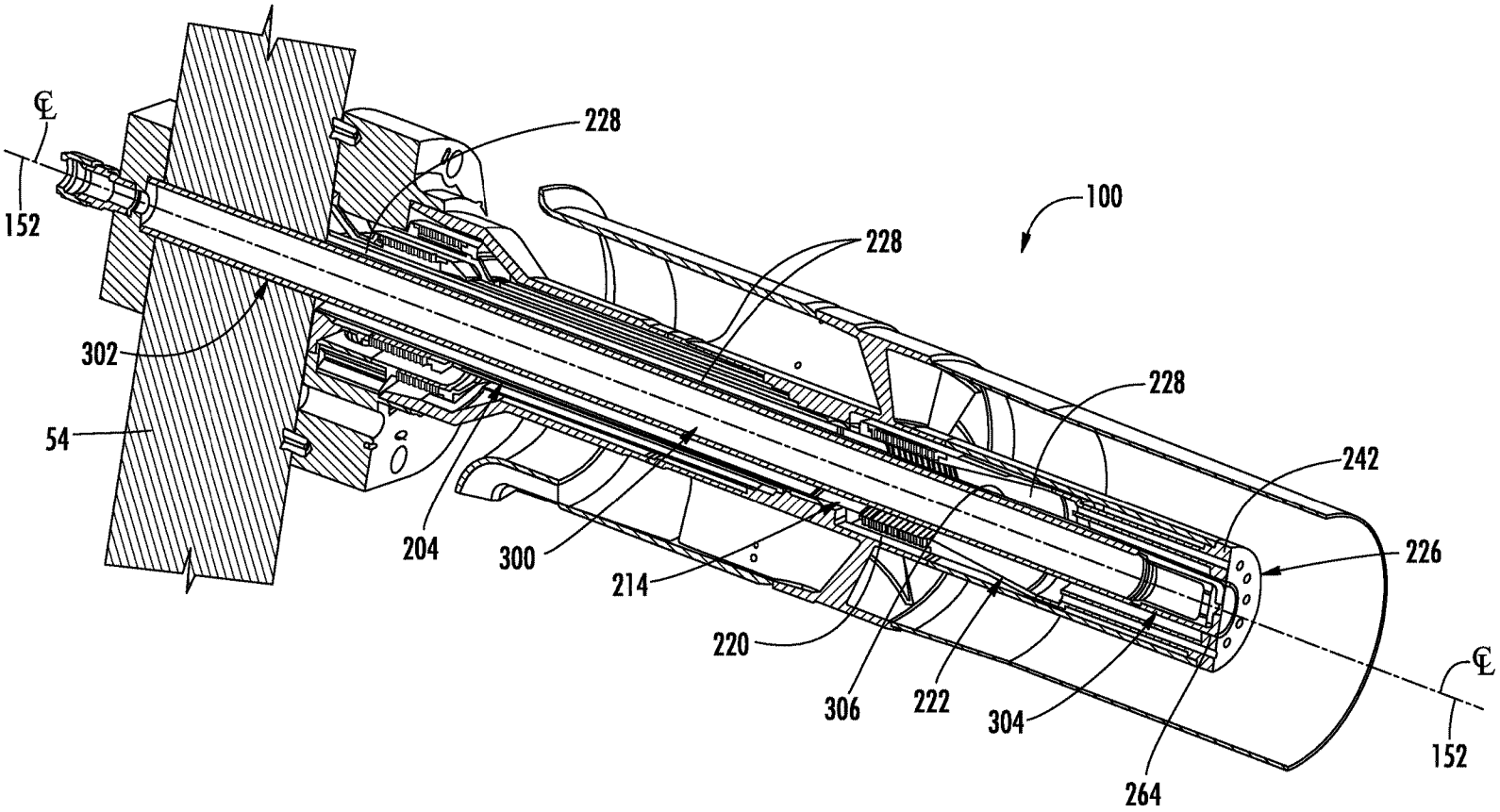
FIG. 9 is a cross sectioned perspective view of the premix fuel nozzle assembly as shown in FIGS. 3 and 7, according to various embodiments of the present invention.

FIG. 9 provides a cross sectioned perspective view of the premix fuel nozzle assembly 100 as shown in FIGS. 3 and 7 according to various embodiments of the present invention. In particular embodiments, as shown in FIG. 9, the premix fuel nozzle assembly 100 includes a purge air cartridge assembly 300 for converting or modifying the premix fuel nozzle assembly 100 from a dual fuel type premix fuel nozzle assembly 100 to a gas fuel only or "gas only" configuration. The purge air cartridge assembly 300 extends generally axially with respect to centerline 152. In particular embodiments the purge air cartridge assembly 300 is concentrically aligned with the pilot premix fuel nozzle assembly 200 and/or the center body 110 with respect to centerline 152. The purge air cartridge assembly 300 extends axially within the pilot air passage 228 through the stem 204, the coupling collar 214, the bellows 220, the flow expansion collar 222, and the premix tip 226 and at least partially through an opening 264 (FIGS. 8 and 9) defined or formed in the fuel distribution disk 242.

The purge air cartridge assembly 300 generally includes a feed tube portion 302 and a tip portion 304. In particular embodiments, the feed tube portion 302 extends through an opening defined in the end cover 54. The purge air cartridge assembly 300, particularly the feed tube portion 302 is in fluid communication with a purge air supply (not shown). The purge air cartridge assembly 300 may be coupled or connected to the end cover 54 via bolts or other suitable fasteners (not shown). The feed tube portion 302 and the tip portion 304 generally define a purge air passage 308 through the purge air cartridge assembly 300. The purge air cartridge assembly 300 may be breech loaded through the end cover 54. In various embodiments, the pilot air passage 228 is at least partially defined between an outer surface 306 of the purge air cartridge assembly 300 and the stem 204, the coupling collar 214, the bellows 220, the flow expansion collar 222, and the premix tip 226 of the pilot premix fuel nozzle assembly 200.

Figure 10:
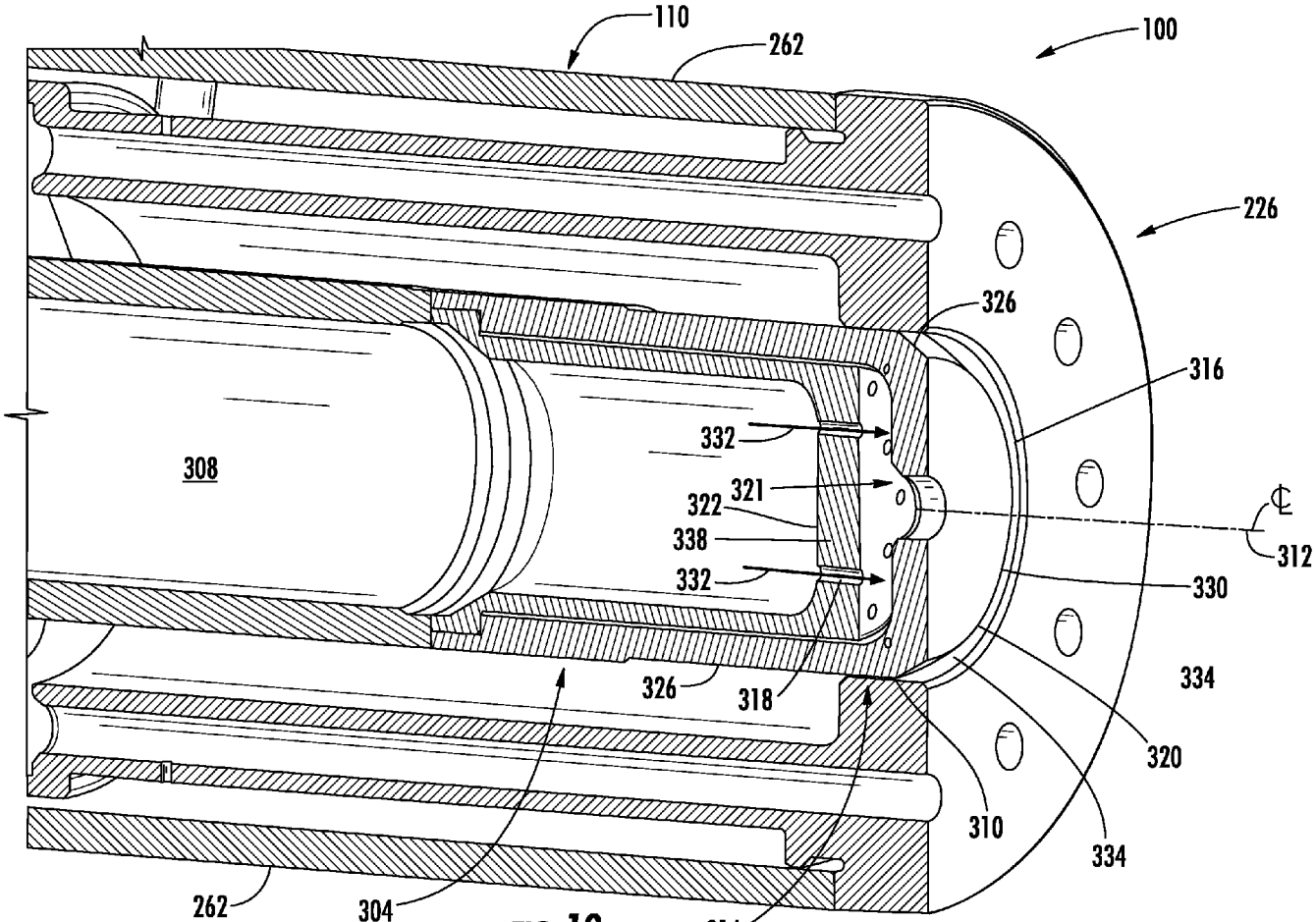
FIG. 10 is an enlarged cross sectioned perspective view of a portion of the premix fuel nozzle assembly as shown in FIG. 9, according to at least one embodiment of the present invention.

FIG. 10 provides an enlarged cross sectioned perspective view of a portion of the premix fuel nozzle assembly 100 including a portion of the center body 110, the premix tip 226 of the pilot premix fuel nozzle assembly 200 and the tip portion 304 of the air cartridge assembly 300, according to at least one embodiment of the present invention. In various embodiments, as shown in FIG. 10, the tip portion 304 of the air cartridge assembly 300 includes an aft wall 310. The aft wall 310 extends radially and circumferentially with respect to an axial centerline 312 of the air cartridge assembly 300 at or adjacent to a downstream end 314 of the tip portion 304. A single orifice 316 is formed through the aft wall 310. In one embodiment, the orifice 316 is formed through the aft wall 310 concentric with the centerline 312. The orifice 316 extends through a forward side 318 and an aft side 320 of the aft wall 310 and provides for fluid communication from the purge air passage 308 through the aft wall 310.

Figure 11:
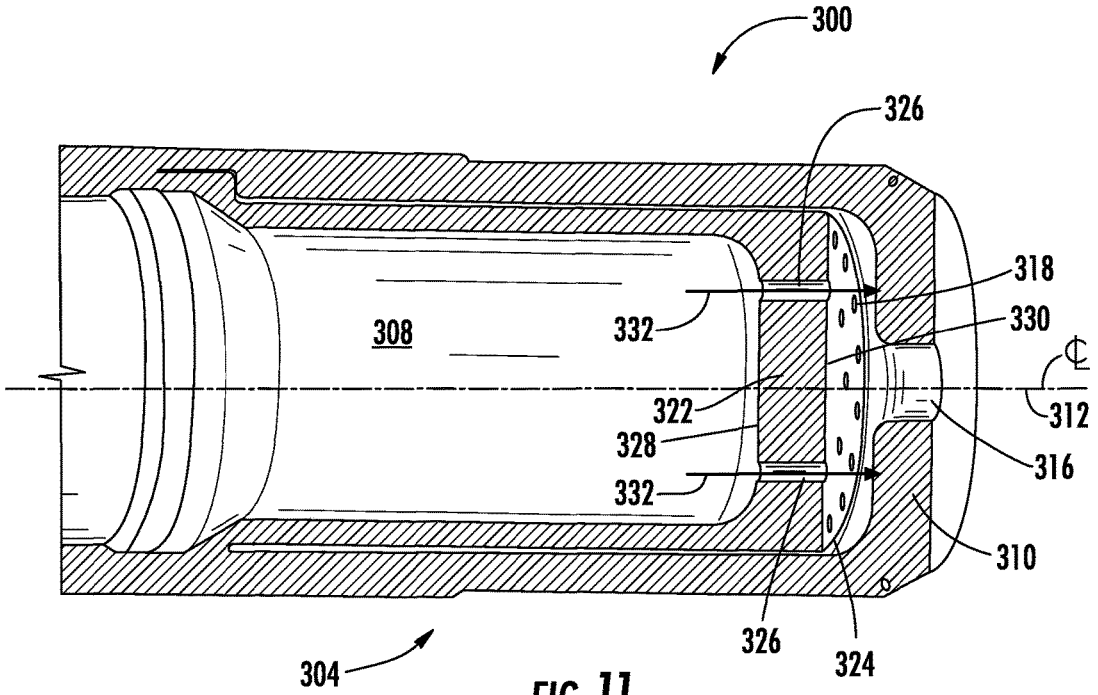
FIG. 11 is an enlarged cross sectioned perspective side view of a tip portion of an air cartridge assembly as shown in FIG. 10, according to at least one embodiment of the present invention.

FIG. 11 provides an enlarged cross sectioned perspective side view of the tip portion 304 of the air cartridge assembly 300 as shown in FIG. 10, according to at least one embodiment of the present invention. As shown in FIGS. 10 and 11, the air cartridge assembly 300 may include an impingement plate or insert 322. The impingement plate 322 extends radially and circumferentially with respect to centerline 312 within the tip portion 304 upstream from the inner side 318 of the aft wall 310. The impingement plate 322 is axially spaced from the inner side 316 of the aft wall 310 so as to define an impingement plenum 324 therebetween. The impingement plate 322 includes a plurality of impingement holes 326 that extend through an upstream side 328 and a downstream side 330 of the impingement plate 322. The impingement holes 326 provide for fluid communication from the purge air passage 308 through impingement plate 322 and into the impingement plenum 324. The impingement holes 326 are generally oriented and/or configured to direct a flow of purge medium or air 332 from the purge medium supply (not shown) and the purge air passage 308 against the forward side 318 of the aft wall 310, thus providing impingement or jet cooling to the aft wall 310 during operation of the combustor 24.

As shown in FIG. 10, a radial gap or cavity 334 may be defined or formed between the tip portion 304 of the cartridge assembly 300 proximate top the aft wall 310 and the opening 201 defined or formed in the fuel distribution disk 242. The cavity 334 may cause or result the formation of a recirculation zone at the aft wall 310.

Figure 12:
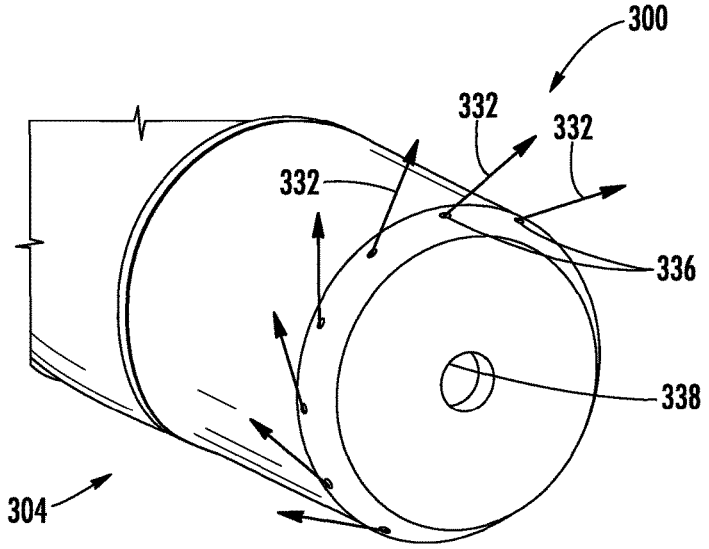
FIG. 12 is a perspective view of a tip portion of an air cartridge assembly as shown in FIG. 11, according to one embodiment of the present invention.

FIG. 12 provides a perspective view of the tip portion 304 of the air cartridge assembly 300 as shown in FIGS. 9-11, according to one embodiment of the present invention. In one embodiment, as shown in FIG. 12, a plurality of purge passages 336 are defined along a chamfered, slanted or diverging side wall portion 338 of the aft wall 310. The purge passages 336 are oriented or configured to flow a portion of the purge air 332 from the impingement plenum 324 and/or the purge air passage 308 radially outwardly and in a circumferential or tangential direction into the cavity 334 (FIG. 11) thus preventing formation of the recirculation zone during operation of the combustor 24.

Figure 13:
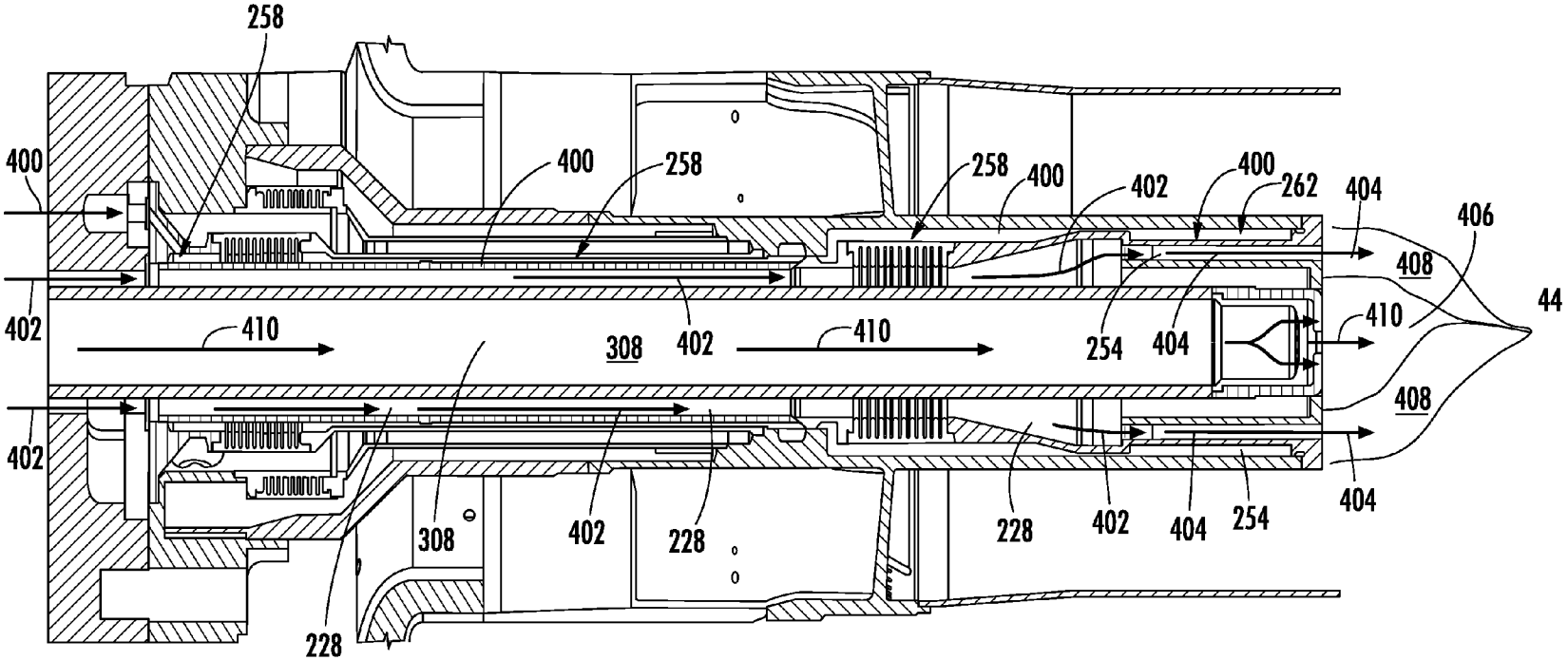
FIG. 13 is a cross sectioned side view of the premix fuel nozzle assembly showing various flow paths of fuel and air or a purge medium through the premix fuel nozzle assembly as shown in FIG. 9, according to one or more embodiments of the present invention.

FIG. 13 provides a cross sectioned side views of the premix fuel nozzle assembly 100 showing various flow paths of fuel and a purge medium such as compressed air through the premix fuel nozzle assembly 100, according to one or more embodiments of the present invention. During piloted premix operation of the combustor 24, as shown in FIG. 13 and in various FIGS. provided herein and as described, a gaseous fuel 400 is routed through inlet passage 260 and into the pilot fuel flow path 258. In particular embodiments, the alignment or standoff features 208, 216 maintain a desired radial gap between the pilot premix fuel nozzle assembly 200 and the inner surface(s) 126 of the center body 110 sleeve(s) 124, thus ensuring proper fuel flow of the gaseous fuel through the pilot fuel flow path 258.

The gaseous fuel 400 enters the fuel plenum 262 and flows or circulates around the outer surface 240 of the premix tip 226 and/or within the grooves 248 formed or defined between each circumferentially adjacent premix tube 238. The gaseous fuel 400 may provide convective and/or conductive cooling to the premix tip 226 and/or the fuel distribution disk 242. The gaseous fuel 400 is then injected into the premix passage 254 of each premix tube 238 via fuel port(s) 256.

Simultaneously, pilot premix air 402 is routed through the pilot air passage 228. The pilot premix air 402 flows through the stem 204, the coupling collar 214, and the bellows 220 and into the flow expansion collar 222. A portion of the pilot premix air 402 flows through the inlet end 250 of each premix tube 238 and enters the corresponding premix passage 254 upstream from the fuel port(s) 256. The gaseous fuel 400 and the pilot premix air 402 forms a premixed pilot fuel-air mixture 404 as they flow through the premix passage(s) 254 and exit through the respective outlet ends 252 of each premix tube 238. The premixed pilot fuel-air mixture 404 flows into the combustion chamber 44 and/or a reaction zone 406 where the premixed pilot fuel-air mixture 404 is burned as a pilot premix flame 408.

In particular embodiments, a purge or cooling medium 410 such as compress air is routed into the purge air passage 308. In one or more embodiments, the purge medium 410 flows through the impingement passages 326 and impinges or strikes the forward side 318 of the aft wall 310, thus providing impingement or jetted cooling to the aft wall 310. The purge medium 410 flows through the axially extending orifice 316 and enters the reaction zone 406 concentric with the piloted premix flame 410. In one embodiment, a portion (i.e. less than 20 percent) of the purge medium 410 may be routed through the purge passages 336 to purge the radial gap 334.

Figure 14:
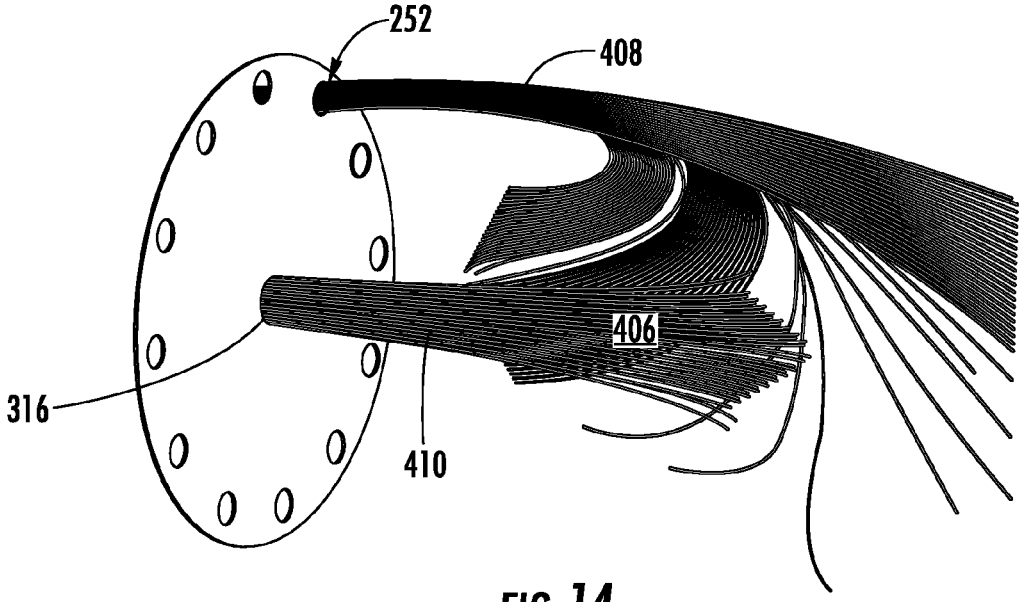
FIG. 14 is a perspective view of a downstream end of a pilot premix flow nozzle assembly in pilot premix operation according to one embodiment of the present invention.

FIG. 14 provides a perspective view of the spatial relationship between the purge medium 410 flowing through the axially extending orifice 316 and the piloted premix flame 408 within the reaction zone 406. The axial flow direction of the purge medium 410 into the reaction zone 406 piloted premix flame 408 increases premix pilot flame stability when compared to conventional gas only cartridges which generally flow or direct the purge medium radially outwardly which may result in quenching of the piloted premix flame 408. Quenching of the piloted premix flame 408 generally results in less than desirable or non-optimal pilot flame and cartridge purge air interaction, less than optimal reaction rates at the pilot flame thus resulting in impacts to emissions performance and lower than optimal temperatures surrounding the pilot flames which may result in less than optimal kinetic reaction rates.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A premix fuel nozzle assembly, comprising:

a center body at least partially defined by a sleeve having an inner surface;

a pilot premix fuel nozzle assembly that extends axially through the center body within the sleeve and defines a pilot air passage within the pilot premix fuel nozzle assembly, the pilot premix fuel nozzle assembly including a premix tip having a plurality of premix tubes, each premix tube defining a premix passage and a fuel port positioned axially between an inlet of the premix tube and an outlet of the premix tube, wherein the premix passage is in fluid communication with the pilot air passage;

a pilot fuel flow path defined radially between the pilot premix fuel nozzle assembly and the inner surface of the sleeve of the center body; and a fuel plenum at least partially defined by the sleeve inner surface and an outer surface of the premix tip, wherein each fuel port extends radially through the corresponding premix tube from the fuel plenum to the corresponding premix passage to provide for fluid communication between the fuel plenum and the premix passages.

2. The pre fuel nozzle assembly as in claim 1, wherein the pilot fuel flow path extends axially between an inlet passage and the fuel plenum.

3. The premix fuel nozzle assembly as in claim 1, wherein the premix nozzle is a dual fuel premix fuel nozzle.

4. The premix fuel nozzle assembly as in claim 1, wherein the pilot premix fuel nozzle assembly includes a stem, a coupling collar, a bellows and a flow expansion collar connected in sequence upstream from the premix tip.

5. The premix fuel nozzle assembly as in claim 4, further comprising a liner that circumferentially surrounds the bellows.

6. The premix fuel nozzle assembly as in claim 5, wherein the bellows and the liner at least partially define a plenum therebetween.

7. The premix fuel nozzle assembly as in claim 1, wherein the plurality of premix tubes is annularly arranged around the outer surface of the premix tip within the fuel plenum.

8. The premix fuel nozzle assembly as in claim 1, wherein each premix tube of the plurality of premix tubes extends radially outwardly from the outer surface of the premix tip within the fuel plenum.

9. The premix fuel nozzle assembly as in claim 1, wherein the pilot premix fuel nozzle assembly includes one or more radial offset features which extend radially outwardly from one or more outer surfaces of the pilot premix fuel nozzle assembly within a premix fuel flow path.

10. A combustor, comprising:

an end cover;

a plurality of premix fuel nozzle assemblies annularly arranged about a center fuel nozzle, each premix fuel nozzle assembly of the plurality of premix fuel nozzle assemblies and the center fuel nozzle being fixedly connected to the end cover, each of the premix fuel nozzle assemblies being a dual fuel type premix fuel nozzle assembly, wherein each premix fuel nozzle assembly comprises;

a center body at least partially defined by a sleeve having an inner surface;

a pilot premix fuel nozzle assembly that extends axially through the center body within the sleeve and defines a pilot air passage within the pilot premix fuel nozzle assembly, the pilot premix fuel nozzle assembly including a premix tip having a plurality of premix tubes, each premix tube having an inlet end, and outlet end and a premix passage defined therebetween, each premix tube having a fuel port positioned axially between an inlet of the premix tube and an outlet of the premix tube, wherein the inlet end of the premix tube is in fluid communication with the pilot air passage;

a pilot fuel flow path defined radially between the pilot premix fuel nozzle assembly and the inner surface of the sleeve of the center body; and a fuel plenum at least partially defined by the sleeve inner surface and an outer surface of the premix tip, wherein each fuel port extends radially through the corresponding premix tube from the fuel plenum to the corresponding premix passage to provide for fluid communication between the fuel plenum and the premix passages.

11. The combustor as in claim 10, wherein the pilot fuel flow path extends axially between an inlet passage and the fuel plenum.

12. The combustor as in claim 10, wherein the pilot premix fuel nozzle assembly includes a stem, a coupling collar, a bellows and a flow expansion collar connected in sequence upstream from the premix tip.

13. The combustor as in claim 12, wherein the pilot premix fuel nozzle assembly further comprises a liner that circumferentially surrounds the bellows.

14. The combustor as in claim 13, wherein the bellows and the liner at least partially defined a plenum therebetween.

15. The combustor as in claim 10, wherein the plurality of premix tubes of the pilot premix fuel nozzle assembly is annularly arranged around the outer surface of the premix tip within the fuel plenum.

16. The combustor as in claim 10, wherein each premix tube of the plurality of premix tubes extends radially outwardly from the outer surface of the premix tip within the fuel plenum.

17. The combustor as in claim 10, wherein the pilot premix fuel nozzle assembly includes one or more radial offset features which extend radially outwardly from one or more outer surfaces of the pilot premix fuel nozzle assembly within a premix fuel flow path.

18. The combustor as in claim 10, wherein the combustor is a component of a gas turbine.

19. The combustor as in claim 10, wherein the outlet ends of the premix tubes of the plurality of premix tubes is annularly arranged about a fuel distribution disk portion of the premix tip.

* * * * *